US006367222B1

(12) United States Patent
Timbrel et al.

(10) Patent No.: US 6,367,222 B1
(45) Date of Patent: Apr. 9, 2002

(54) SHEET OF SHINGLES

(76) Inventors: Jay S. Timbrel, 3766 Jefferson Ave., Ogden, UT (US) 84403; Denise M. Williams, 30 W. Lester Ave., D 21, Murray, UT (US) 84107

( * ) Notice: Subject to any disclaimer, the term of this patent is extended or adjusted under 35 U.S.C. 154(b) by 0 days.

(21) Appl. No.: 09/632,603

(22) Filed: Aug. 4, 2000

(51) Int. Cl.[7] ..... E04D 1/26; E04D 1/30

(52) U.S. Cl. ..... 52/555; 52/57; 52/518; 52/557; 52/746.11; 52/748.1

(58) Field of Search ..... 52/57, 518, 551, 52/555, 748.1, DIG. 16, 554, 557, 746.11

(56) References Cited

U.S. PATENT DOCUMENTS 4,439,955 A * 4/1984 Freiborg ..... 52/57
4,580,389 A * 4/1986 Freiborg ..... 52/748.1
4,587,785 A * 5/1986 Rohner ..... 52/420
5,271,201 A * 12/1993 Noone et al. ..... 52/57 X
6,182,400 B1 * 2/2001 Freiborg et al. ..... 52/57

* cited by examiner

*Primary Examiner*—Laura A. Callo
(74) *Attorney, Agent, or Firm*—Thompson E. Fehr

(57) ABSTRACT

A sheet of shingles for application to the ridge or hips of a roof. Two or more shingles are arranged in a generally straight line with the tops of adjacent shingles generally aligned with one another, with the bottoms of adjacent shingles generally aligned with one another. The second edge of a prior shingle overlaps and is above the first edge of any immediately subsequent shingle. Adhesive is placed in the overlapping area of adjacent shingles to connect such shingles, leaving the corners unattached so that the upper, overlapping corners can be lifted to nail the lower, overlapped corners to the roof. Tar is placed between the overlapping and the overlapped corners in order to utilize solar energy to seal the corners of the adjacent shingles to one another after the nails have been inserted.

18 Claims, 2 Drawing Sheets

SHEET OF SHINGLES

BACKGROUND OF THE INVENTION

1. Field of the Invention

This invention relates to a device and method for applying shingles to the ridge and hips of a roof.

2. Description of the Related Art

Considerable time is spent aligning the shingles which are place upon the areas where two generally planar sections of a roof meet to form an acute angle between the bottoms of such sections. The line formed where such sections meet at a high point of the roof is termed the ridge. Lines extending downward from the ridge formed where such planar sections meet are termed hips.

Various types of shingles exist that have been designed to be applied individually to the ridge of a roof.

U.S. Pat. No. 4,835,929 covers a two-play shingle which has a third ply laminated to the top of one end of the shingle and which can be folded along its longitudinal middle.

A foldable, rigid shingle is the subject of U.S. Pat. No. 5,247,771.

The shingle of U.S. Pat. No. 5,295,340 consists an inverted V-shaped top cover sheet and a tapered inverted V-shaped substrate which may optionally contain an adhesive that will melt under solar heating to cause the substrate to adhere to the underlying surface more than will just the nails that attach the shingle to the underlying surface.

All the preceding types of shingles, however, suffer from the same disadvantage discussed above, viz., it takes considerable time to align them in a satisfactory manner.

Another group of patented roofing material for the ridges of roofs minimizes this difficulty concerning alignment by consisting of a much larger structure than a single shingle which is designed to appear to be composed of separate shingles. This group includes the devices of U.S. Pat. No. 5,050,357 and U.S. Pat. No. 5,375,387. Close inspection will, however, disclose that there are not separate shingles, causing the device to be considered an imitation.

The invention of U.S. Pat. No. 4,731,970 is simply one or more rows of traditional shingles attached to "a sheet-like base 11 which is preferably made of plywood, particle board or other material that is weather resistant and adequate for sheathing." The disclosure and claims for this invention do not suggest that the invention is applicable to ridges and hips of roofs.

The roof venting system of U.S. Pat. No. 5,425,672 places an air-permeable mat over an open slot along the ridge of a roof and covers such mat with roof shingles "laid in overlapping rows in the conventional manner . . . "

The "improved shake roof liner" of U.S. Pat. No. 5,570,553 appears to have rows of felt flaps secured to an underlayment. Traditional shingles are secured to the underlayment.

SUMMARY OF THE INVENTION

The present invention uses a series of shingles arranged in a generally straight line.

Each shingle has a top, a bottom, a first edge and a second edge. The tops of adjacent shingles are generally aligned with one another, and the bottoms of adjacent shingles are generally aligned with one another. The second edge of each shingle overlaps and is above the first edge of any immediately subsequent shingle. In the overlapping area of adjacent shingles, the prior shingle is adhesively attached to the subsequent shingle. However, the corners of the second edge are left unattached so that nails can be inserted in the subsequent shingle to fasten the subsequent shingle to the roof. Preferably, tar or a substance with similar melting and adhesive properties is also in the corners of adjacent shingles to use solar energy to seal the prior shingle to the subsequent shingle after the nails have been inserted.

The series of shingles, thus, forms a sheet which can be manipulated more readily and faster than can individuals shingles. All the desirable properties, such as appearance, of individual shingles are, however, retained.

And the installation technique is essentially the same as for individual shingles, viz., nails are inserted through the shingles into the roof. There is no need to deal with a base below the shingles.

DESCRIPTION OF THE PREFERRED EMBODIMENT

Figure 1:
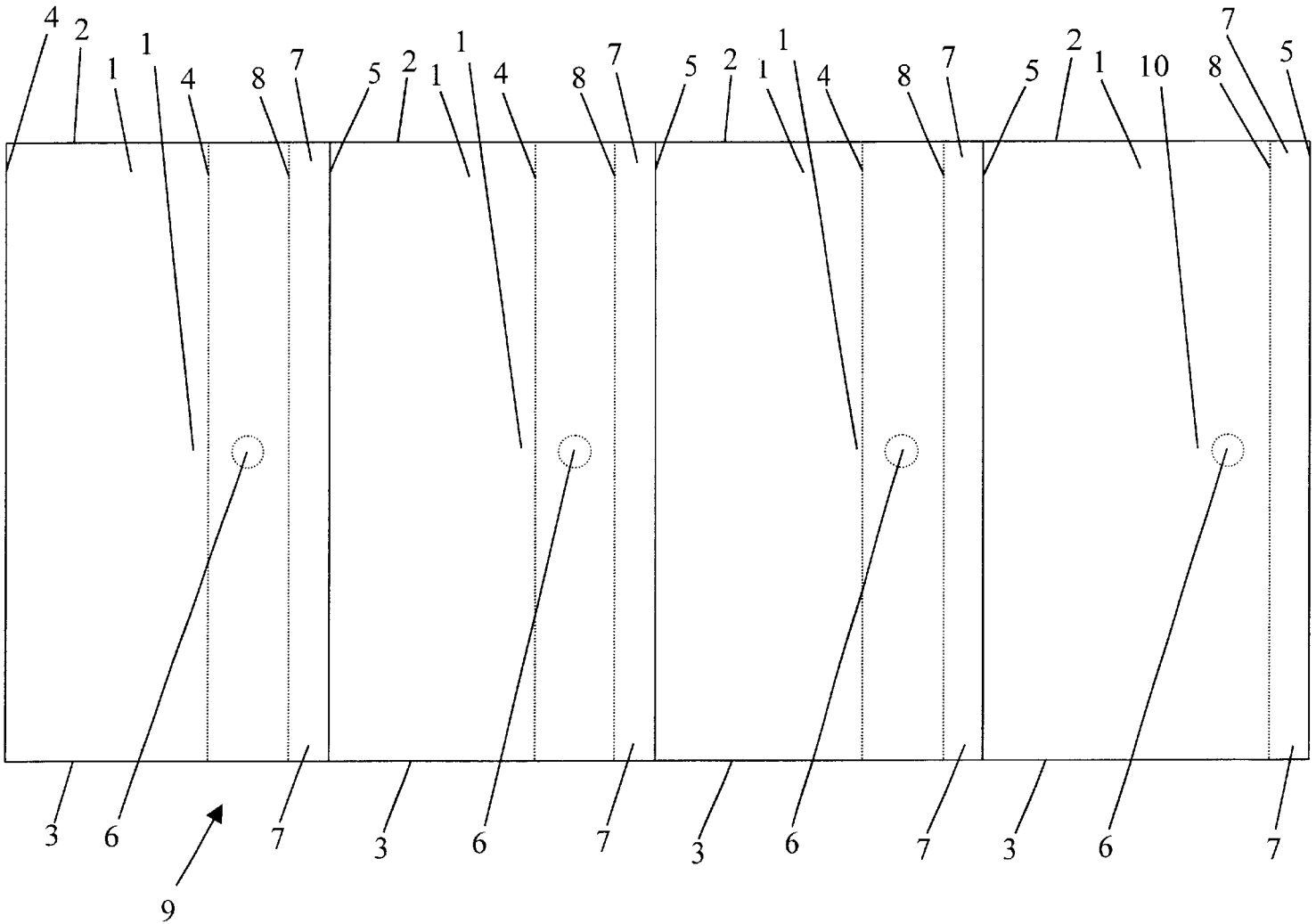
FIG. 1 portrays the Sheet of Shingles having a line of tar running across the entire width of the sheet.
Figure 2:
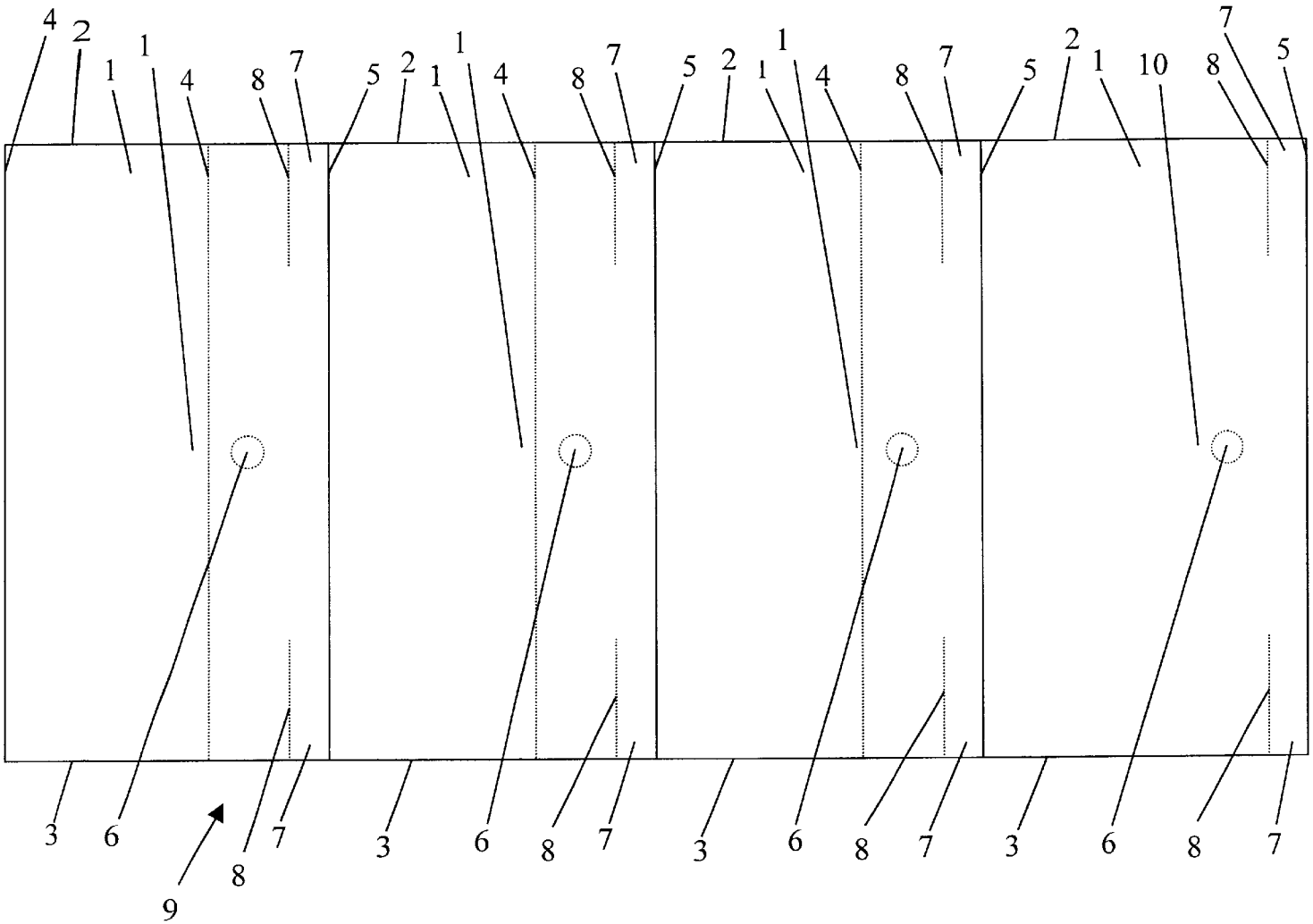
FIG. 2 shows the Sheet of Shingles having tar in the corners of the area where each prior shingle overlaps each subsequent shingle.

The present invention uses a series of shingles 1, preferably traditional shingles 1, arranged in a generally straight line.

As discussed above, each shingle has a top 2, a bottom 3, a first edge 4, and a second edge 5. The tops 2 of adjacent shingles are generally aligned with one another, and the bottoms 3 of adjacent shingles are generally aligned with one another. The second edge 5 of each shingle 1 overlaps and is above the first edge 4 of any immediately subsequent shingle 1. In the overlapping area of adjacent shingles, the prior shingle 1 is attached with adhesive 6 to the immediately subsequent shingle 1. However, each corner 7 on the second edge 5 is left unattached so that nails can be inserted in the corner 7 on the first edge 4 of any immediately subsequent shingle 1 to fasten the subsequent shingle 1 to the roof. Preferably, tar 8 or a substance with similar melting and adhesive properties is also placed in the corners 7 of adjacent shingles to use solar energy to seal the prior shingle 1 to any immediately subsequent shingle 1 after the nails have been inserted.

Also preferably, the tar 8 extends in a line parallel to the second edge 5 of the shingle 1 and preferably from the top 2 to the bottom 3 of the shingle 1.

The adhesive 6 is preferably one that is flexible such as those used to seal the edges of automobile windshields. The adhesive 6 is preferably placed one inch from the second edge 5 of the prior shingle 1 and is preferably located at the position of the shingle 1 that is intended to be above the apex of the hip or ridge of the roof.

Just as with individual shingles 1, the resultant sheet 9 of shingles 1 is aligned along the hip or ridge of the roof, bent along the longitudinal center 10 of the sheet 9, and nailed to the roof.

The sheet of shingles could be left in a planar form, preferably approximately four feet long or, when such sheet would not be installed during cold weather that could cause cracking if such sheet were bent, extended to a greater length and rolled for storage and shipment.

Use of the sheet of shingles eliminates a significant amount of the alignment that an installer must undertake and, therefore, significantly expedites the time required to install shingles along the ridge and hip of a roof.

We claim:

1. A sheet of shingles, which comprises:

two or more shingles, each shingle having a top, a bottom, a first edge, a second edge, and corners, arranged in a generally straight line such that the tops of adjacent shingles are generally aligned with one another, the bottoms of adjacent shingles are generally aligned with one another, and the second edge of each shingle overlaps and is above the first edge of any immediately subsequent shingle;

adhesive located in the overlapping area of adjacent shingles to attach each prior shingle to each immediately subsequent shingle, leaving the corners unattached; and a substance having the melting and adhesive properties of tar placed in the overlapping area of adjacent shingles between the corners of the second edge of each prior shingle and the corners of the first edge of any immediately subsequent shingle.

2. The sheet of shingles as recited in claim 1, wherein:

said substance having the melting and adhesive properties of tar is tar.

3. The sheet of shingles as recited in claim 2, wherein:

said adhesive is flexible.

4. The sheet of shingles as recited in claim 3, wherein:

said adhesive is located at the position of each of said shingles that is intended to be above the apex of the hip or ridge of the roof.

5. The sheet of shingles as recited in claim in claim 2, wherein:

said adhesive is located at the position of each of said shingles that is intended to be above the apex of the hip or ridge of the roof.

6. The sheet of shingles as recited in claim 1, wherein:

said adhesive is flexible.

7. The sheet of shingles as recited in claim in claim 6, wherein:

said adhesive is located at the position of each of said shingles that is intended to be above the apex of the hip or ridge of the roof.

8. The sheet of shingles as recited in claim in claim 1, wherein:

said adhesive is located at the position of each of said shingles that is intended to be above the apex of the hip or ridge of the roof.

9. A sheet of shingles, which comprises:

two or more shingles, each shingle having a top, a bottom, a first edge, a second edge, and corners, arranged in a generally straight line such that the tops of adjacent shingles are generally aligned with one another, the bottoms of adjacent shingles are generally aligned with one another, and the second edge of each shingle overlaps and is above the first edge of any immediately subsequent shingle;

adhesive located in the overlapping area of adjacent shingles to attach each prior shingle to each immediately subsequent shingle, leaving the corners unattached; and a substance having the melting and adhesive properties of tar placed in the overlapping area of adjacent shingles extending in a line generally parallel to the second edge of a prior shingle from the top to the bottom of said prior shingle between said prior shingle and any immediately subsequent shingle.

10. The sheet of shingles as recited in claim 9, wherein:

said substance having the melting and adhesive properties of tar is tar.

11. The sheet of shingles as recited in claim 10, wherein:

said adhesive is flexible.

12. The sheet of shingles as recited in claim 11, wherein:

said adhesive is located at the position of each of said shingles that is intended to be above the apex of the hip or ridge of the roof.

13. The sheet of shingles as recited in claim in claim 10, wherein:

said adhesive is located at the position of each of said shingles that is intended to be above the apex of the hip or ridge of the roof.

14. The sheet of shingles as recited in claim 9, wherein:

said adhesive is flexible.

15. The sheet of shingles as recited in claim in claim 14, wherein:

said adhesive is located at the position of each of said shingles that is intended to be above the apex of the hip or ridge of the roof.

16. The sheet of shingles as recited in claim in claim 9, wherein:

said adhesive is located at the position of each of said shingles that is intended to be above the apex of the hip or ridge of the roof.

17. A method for creating a sheet of shingles for application to the ridge or hips of a roof, which comprises:

arranging two or more shingles, each shingle having a top, a bottom, a first edge, a second edge, and corners, in a generally straight line such that the tops of adjacent shingles are generally aligned with one another, the bottoms of adjacent shingles are generally aligned with one another, and the second edge of each shingle overlaps and is above the first edge of any immediately subsequent shingle;

locating adhesive in the overlapping area of adjacent shingles to attach each prior shingle to each immediately subsequent shingle, leaving the corners unattached; and placing a substance having the melting and adhesive properties of tar in the overlapping area of adjacent shingles between the corners of the second edge of each prior shingle and the corners of the first edge of any immediately subsequent shingle.

18. A method for creating a sheet of shingles for application to the ridge or hips of a roof, which comprises:

arranging two or more shingles, each shingle having a top, a bottom, a first edge, a second edge, and corners, in a generally straight line such that the tops of adjacent shingles are generally aligned with one another, the bottoms of adjacent shingles are generally aligned with one another, and the second edge of each shingle overlaps and is above the first edge of any immediately subsequent shingle;

locating adhesive in the overlapping area of adjacent shingles to attach each prior shingle to each immediately subsequent shingle, leaving the corners unattached; and placing a substance having the melting and adhesive properties of tar in the overlapping area of adjacent shingles extending in a line generally parallel to the second edge of a prior shingle from the top to the bottom of said prior shingle between said prior shingle and any immediately subsequent shingle.

* * * * *